US007401607B2

(12) United States Patent
Yeh

(10) Patent No.: US 7,401,607 B2
(45) Date of Patent: Jul. 22, 2008

(54) PAINTBALL GUN TRIGGERING MECHANISM

(75) Inventor: Hsin-Cheng Yeh, Yung Kang (TW)

(73) Assignee: Sunworld Industrial Co., Ltd, Tainan Hsien (TW)

( * ) Notice: Subject to any disclaimer, the term of this patent is extended or adjusted under 35 U.S.C. 154(b) by 60 days.

(21) Appl. No.: 11/419,421

(22) Filed: May 19, 2006

(65) Prior Publication Data

US 2007/0267005 A1 Nov. 22, 2007

(51) Int. Cl.
*F41B 11/02* (2006.01)

(52) U.S. Cl. ..... 124/74

(58) Field of Classification Search ..... 124/71–77
See application file for complete search history.

(56) References Cited

U.S. PATENT DOCUMENTS 5,769,066 A * 6/1998 Schneider ..... 124/75
5,778,868 A * 7/1998 Shepherd ..... 124/76
6,644,295 B2 * 11/2003 Jones ..... 124/77
6,810,871 B2 * 11/2004 Jones ..... 124/77
6,901,923 B2 * 6/2005 Jones ..... 124/77
2003/0005918 A1 * 1/2003 Jones ..... 124/70
2004/0255923 A1 * 12/2004 Carnall et al. ..... 124/73

* cited by examiner

*Primary Examiner*—Troy Chambers
(74) *Attorney, Agent, or Firm*—WPAT, P.C.

(57) ABSTRACT

A paintball gun triggering mechanism includes a front barrel, a rear barrel, a triggering barrel and a rear guide rod. A front end of the front barrel comprises a front ring formed inwardly and a retreating air inlet is provided behind the front ring. A front end of the rear barrel is fixedly connected to a rear end of the front barrel, and a retreating air outlet, a rear ring and a launching air inlet are provided in sequence behind the connecting portion of the front barrel and the rear barrel. The triggering barrel comprises a center ring formed at a center outer portion thereof and is placed in the front barrel and the rear barrel. The rear guide rod has a piston at a front end thereof to be inserted into the triggering barrel, and has its rear end secured to the rear end of the rear barrel.

4 Claims, 4 Drawing Sheets

PAINTBALL GUN TRIGGERING MECHANISM

BACKGROUND OF THE INVENTION

1. Field of the Invention

The present invention relates to a paintball gun triggering mechanism, in particular to a structure having an isolating ring to partition a center section and a rear section of a barrel structure in the gun, including a piston and a push rod, so that the push rod will link the piston to push a paintball bullet and to increase the space for more high-pressure air to be entered into a chamber.

2. Description of the Prior Art

Paintball guns are widely known in the market, many of which have been patented, such as U.S. Pat. Nos. 6,644,295, 6,810,871, and 6,901,923, all of which are hereby incorporated by reference in its entirety. Typical paintball guns have a two-section design. The high-pressure air enters a rear end and a rear section of a barrel structure, respectively. The air entering into the rear end of the barrel structure is to push a piston to slide along the barrel structure, while the air entering into the rear section of the barrel structure is to launch a bullet.

The design requires the air to push the bullet to its triggering point before launch, which wastes the high-pressure air. Therefore, there is a need for a paintball gun design that is relatively more efficient.

All referenced patents, applications and literatures are incorporated herein by reference in their entirety. Furthermore, where a definition or use of a term in a reference, which is incorporated by reference herein is inconsistent or contrary to the definition of that term provided herein, the definition of that term provided herein applies and the definition of that term in the reference does not apply.

SUMMARY OF THE INVENTION

It is the primary objective of the present invention to provide a paintball gun triggering mechanism, which has no extra items blocking the barrel structure so that the launching is smooth and saves high-pressure air.

It is another objective of the present invention to provide a paintball gun triggering mechanism, which has a triggering barrel structure and a rear guide rod separated to eliminate the interface of the two parts.

It is a further objective of the present invention to provide a paintball gun triggering mechanism, which has a relatively compact size comparing with a conventional paintball gun.

It is still a further objective of the present invention to provide a paintball gun triggering mechanism, which cuts down launching time and replenishing high-pressure air times.

It is still a further objective of the present invention to provide a paintball gun triggering mechanism, which uses less sealing rings so as to minimize friction and is easy to maintain and dismantle.

It is still a further objective of the present invention to provide a paintball gun triggering mechanism, which minimizes the malfunction rate and is relatively cost-effective.

According to the present invention, there is provided a paintball gun triggering mechanism comprising:

a front barrel structure, said front barrel structure being a hollow barrel having a front end and a rear end thereof, said front end having a front ring formed inwardly, a retreating air inlet being provided behind said front ring;

a rear barrel structure, said rear barrel structure being a hollow barrel having a front end and a rear end thereof, said front end of said rear barrel being fixedly connected to said rear end of said front barrel, a retreating air outlet being provided behind a connecting portion of said front end of said rear barrel and said rear end of said front barrel, a rear ring being provided behind said retreating air outlet, a launching air inlet being provided behind said rear ring;

a triggering barrel structure, said triggering barrel structure being a hollow barrel and comprising a center ring at a center outer portion thereof, said triggering barrel being placed in said front barrel and said rear barrel, said center ring being confined between said front ring and said rear ring; and a rear guide rod, said rear guide rod comprising a front end and a rear end, said front end comprising a piston to be inserted into said triggering barrel, said rear end being secured to said rear end of said rear barrel.

DETAILED DESCRIPTION OF THE PREFERRED EMBODIMENT

Figure 1:
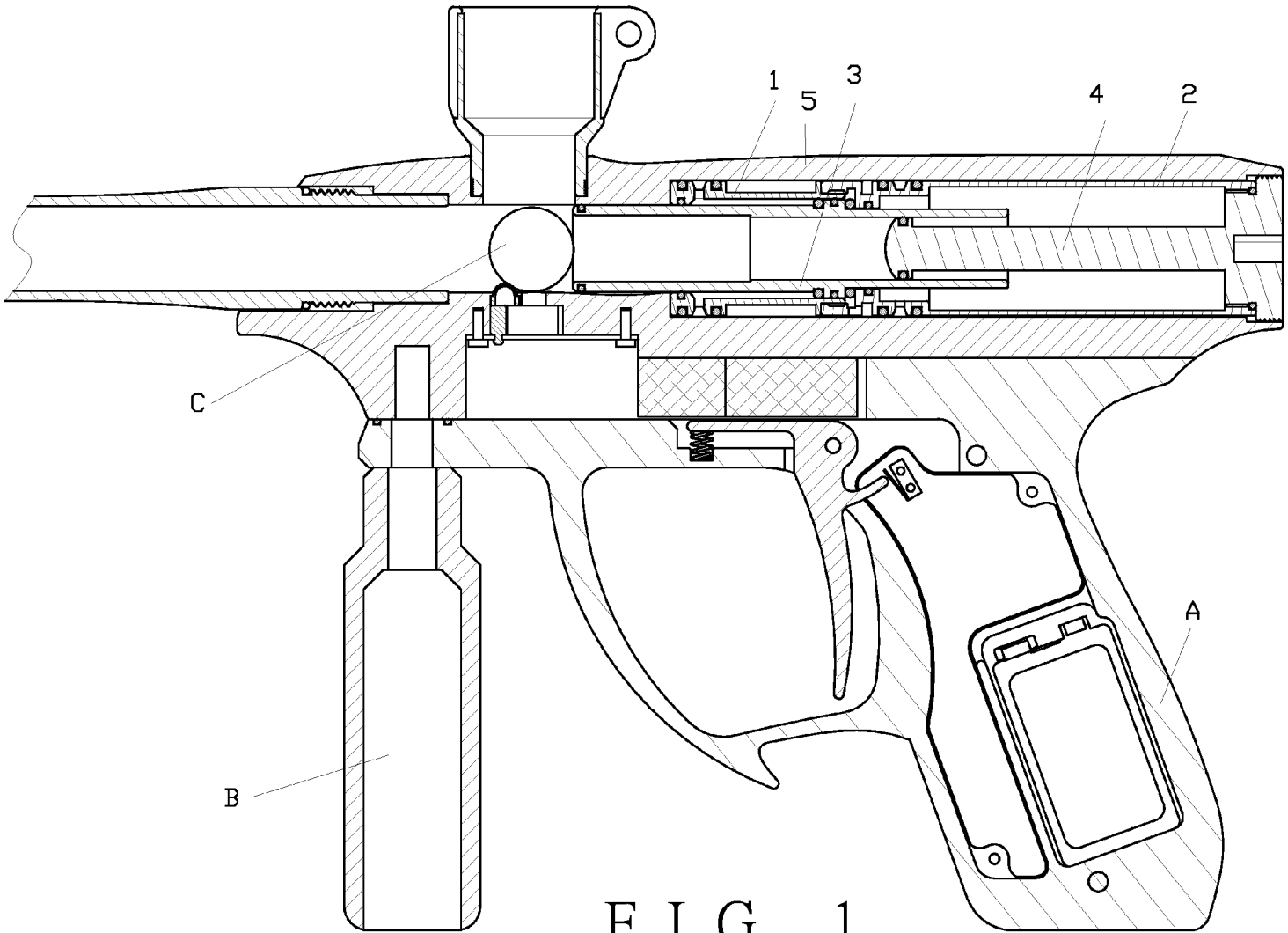
FIG. 1 is a side cross-sectional view of a paintball gun incorporated with the present invention.

As shown in FIG. 1, a preferred embodiment of the present invention comprises a front barrel 1, a rear barrel 2, a triggering barrel 3 and a rear guide rod 4, all of which are installed in a paintball gun body 5. The paintball gun body 5 further includes a handle A, a high-pressure air source B, and a paintball bullet C.

Figure 2:
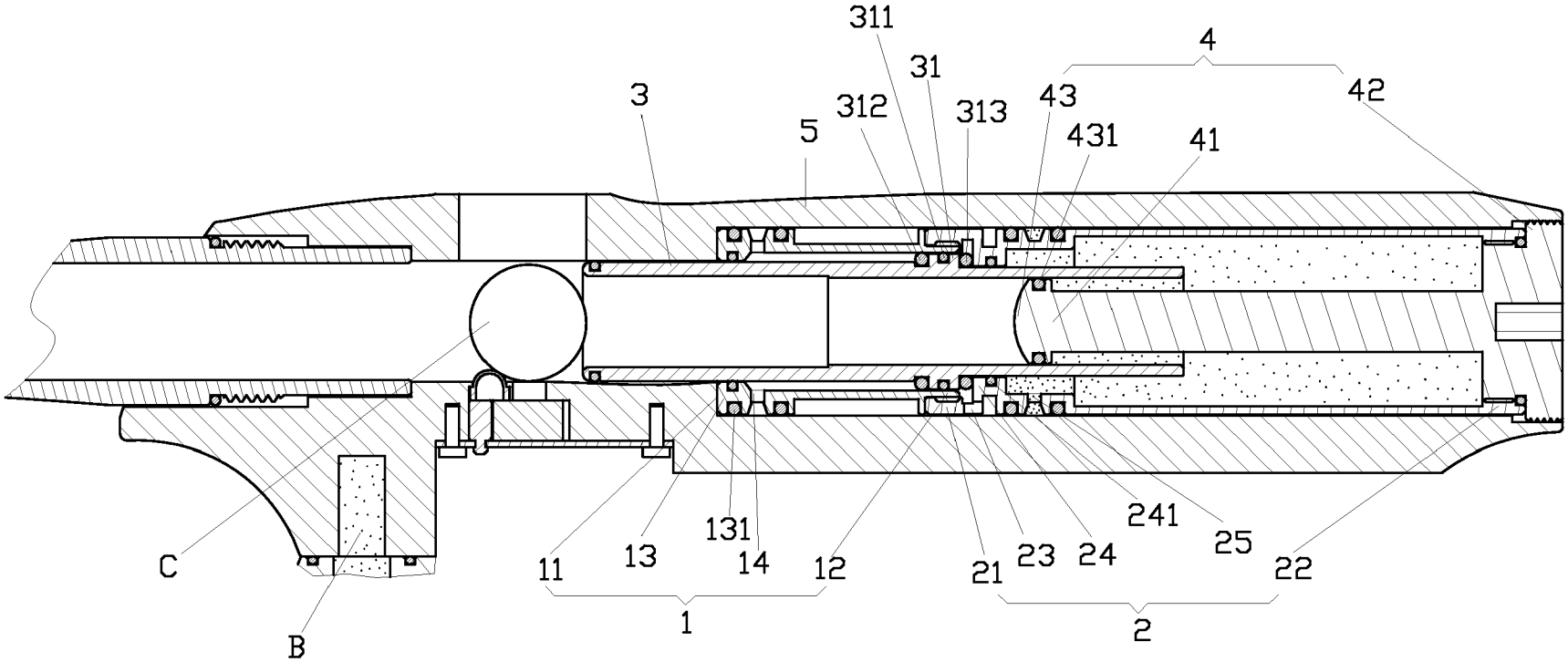
FIG. 2 is a side cross-sectional view of the present invention, showing that high-pressure air is accumulated.

The front barrel 1, as shown in FIG. 2, is a hollow barrel having a front end 11 and a rear end 12. The front end 11 has a front ring 13 formed inwardly with an air seal 131 thereat. A retreating air inlet 14 is formed behind the front ring 13.

The rear barrel 2 is a hollow barrel having a front end 21 and a rear end 22. The front end 21 is fixedly connected to the rear end 12 of the front barrel 1. A retreating air outlet 23 is formed behind the connecting portion of the front end 21 and the rear end 12. A rear ring 24 with an air seal 241 is provided behind the retreating air outlet 23. A launching air inlet 25 is provided behind the air seal 241.

The triggering barrel 3 is a hollow barrel having a center ring 31 formed at a center outer portion thereof. The center ring 31 has an air seal 311 and a pair of buffer rings 312 and 313 at front and rear ends thereof. The triggering barrel 3 is located in the front barrel 1 and the rear barrel 2. The center ring 31 is confined between the front ring 13 and the rear ring 24.

The rear guide rod 4 has a front end 41 and a rear end 42. The front end 41 is provided with a piston 43 to be inserted in the triggering barrel 3. The piston 43 comprises an air seal 431 and is located behind the rear ring 24 of the rear barrel 2. The rear end 42 of the rear guide rod 4 is secured to the rear end 22 of the rear barrel 2.

Figure 3:
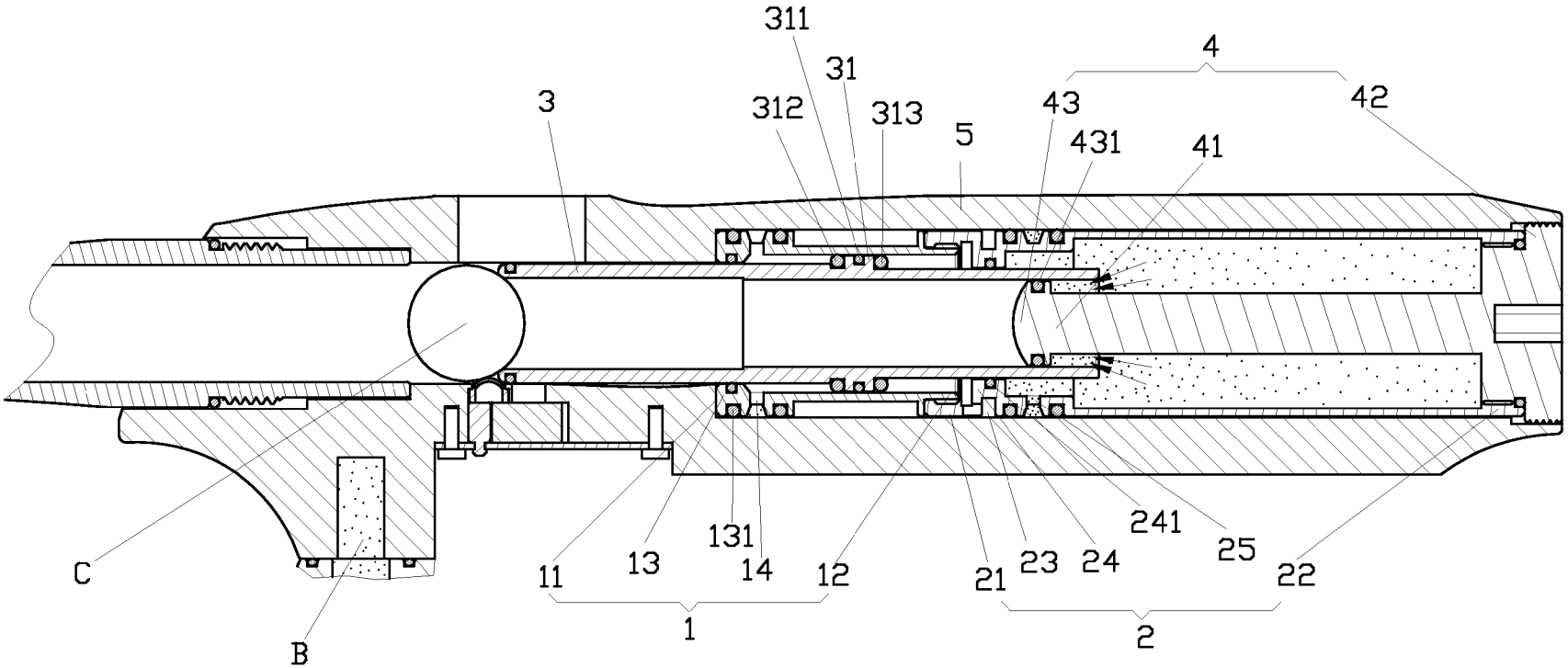
FIG. 3 is a view similar to FIG. 2 showing that a bullet is pushed to a ready launch position.
Figure 4:
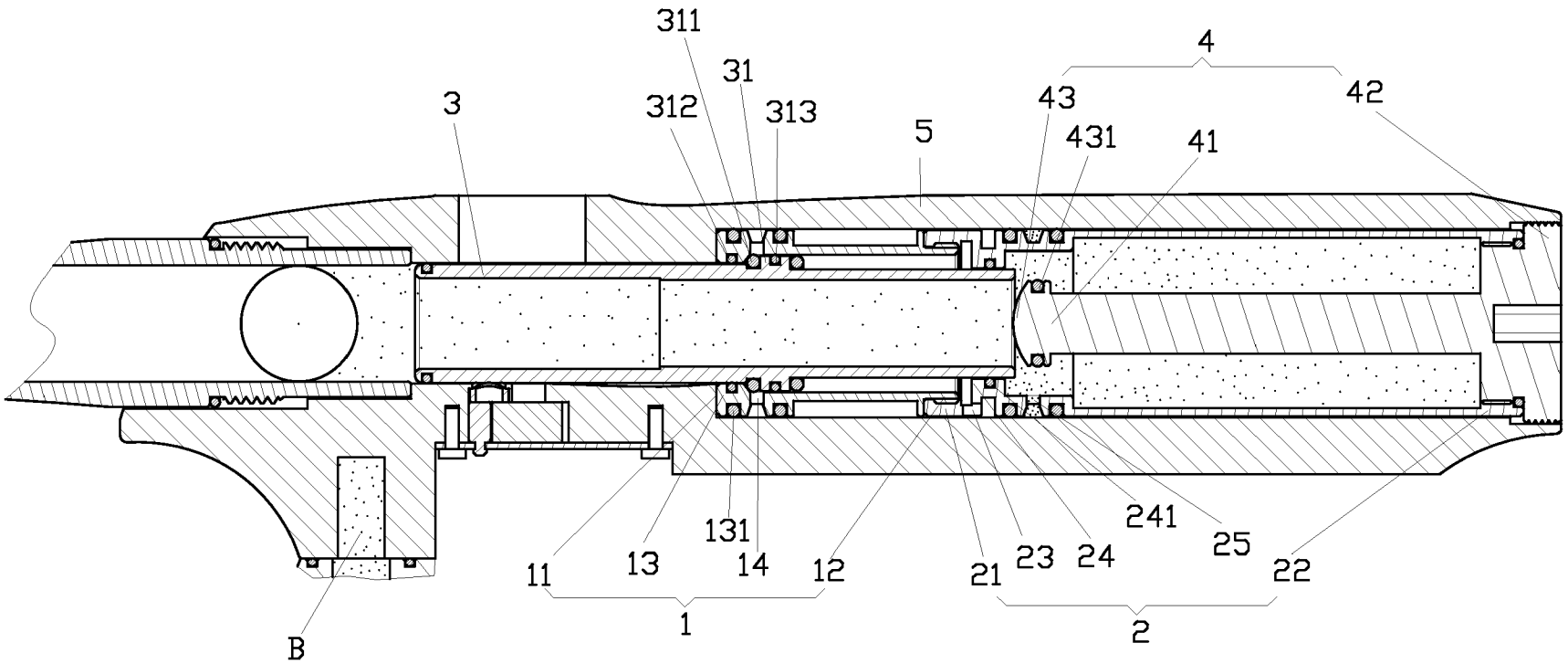
FIG. 4 is still a view similar to FIG. 2 showing that the bullet is triggered.

FIGS. 2 through 4 show the process of the paintball gun triggering mechanism of the present invention from air accumulation, loading and launching. As shown in FIG. 2, the high-pressure air enters the rear barrel 2 from the launching air inlet 25. The air seal 241 is against the outer wall of the triggering barrel 3 and the air seal 431 is against the inner wall of the triggering barrel 3 to form a sealing compartment to store high-pressure air. When the high-pressure air reaches to a level, the triggering barrel 3 is pushed forward, as shown in FIG. 3. The air pressure pushes the bullet C into the triggering barrel 3, while the high-pressure air continues entering into the rear barrel 2 through the launching air inlet 25.

As shown in FIG. 4, when the inner wall of the triggering barrel 3 detaches from the piston 43 of the rear guide rod 4, the high-pressure air strikes the paintball bullet C and launches out of the triggering barrel 3, and the center ring 31 of the triggering barrel 3 will be blocked by the front ring 13 of the front barrel 1.

Upon shooting, the high-pressure air enters in between the front barrel 1 and the triggering barrel 3 through the retreating air inlet 14 and pushes the center ring 31 to urge the trigger barrel 3 to retreat. The inner wall of the triggering barrel 3 engages with the piston 43 of the rear guide rod 4 until the center ring 31 is blocked by the rear ring 24 of the rear barrel 2 and the high-pressure air stored in between the front barrel 1 and the triggering barrel 3 is released through the retreating air outlet 23.

The entire launching process is recycling continuously, few high-pressure air will be guided in between the front barrel 1 and triggering barrel 3 to retreat the triggering barrel 3, and most of the high-pressure air will be guided into the launching air inlet 25 to transfer the bullet C into the triggering barrel 3 and to launch the bullet C, which means the high-pressure air will not be wasted.

Thus, specific embodiments and applications of paintball gun triggering mechanism have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refer to at least one of something selected from the group consisting of A, B, C . . . and N, the text should be interpreted as requiring only one element from the group, not A plus N, or B plus N, etc.

What is claimed is:

1. A paintball gun triggering mechanism comprising:

a front barrel, said front barrel being a hollow barrel having a front end and a rear end thereof, said front end having a front ring formed inwardly, a retreating air inlet being provided behind said front ring;

a rear barrel, said rear barrel being a hollow barrel having an internal space, a front end and a rear end thereof, said front end of said rear barrel being fixedly connected to said rear end of said front barrel, a retreating air outlet being provided behind a connecting portion of said front end of said rear barrel and said rear end of said front barrel, a rear ring being provided behind said retreating air outlet, a launching air inlet being provided behind said rear ring;

a triggering barrel, said triggering barrel being a hollow barrel with no holes on a wall of the triggering barrel, and comprising a hollow space, a center ring at a center outer portion of the hollow barrel, and an opening disposed at a proximal end of the triggering barrel, said triggering barrel being placed in said front barrel and said rear barrel, said center ring being confined between said front ring and said rear ring;

a rear guide rod, said rear guide rod comprising a front end and a rear end, said front end comprising a piston detachably engages with an inner wall of said triggering barrel, said rear end being secured to said rear end of said rear barrel; and wherein the internal space of the rear barrel is disposed proximal to the triggering barrel, wherein the rear guide rod is disposed within the internal space, and when the triggering barrel is in a proximal position and the inner wall is engaged with said piston, the internal space and a distal end of the hollow space of the triggering barrel is not in fluid communication with each other, and when the triggering barrel is in a distal position and the inner wall is detached from said piston, the internal space and the distal end of the hollow space of the triggering barrel is in fluid communication with each other.

2. The paintball gun triggering mechanism, as recited in claim 1, wherein each of said front ring, said center ring, said rear ring and said piston is provided with an air seal.

3. The paintball gun triggering mechanism, as recited in claim 1, wherein said center ring comprises a pair of buffer rings at front and rear ends thereof.

4. The paintball gun triggering mechanism, as recited in claim 1, wherein said piston of the front end of said rear guide rod is located behind said rear ring of said rear barrel.

* * * * *